US006565135B2

(12) United States Patent
Wytcherley et al.

(10) Patent No.: US 6,565,135 B2
(45) Date of Patent: May 20, 2003

(54) PIVOTING-HANDLE DEVICE

(75) Inventors: Roger Wytcherley, Suckley (GB); Clive Morgan, Kidderminster (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/992,812

(22) Filed: Nov. 6, 2001

(65) Prior Publication Data

US 2002/0116785 A1 Aug. 29, 2002

Related U.S. Application Data

(60) Provisional application No. 60/246,044, filed on Nov. 6, 2000.

(51) Int. Cl.[7] ..... E05B 3/00
(52) U.S. Cl. ..... 292/336.3; 292/113
(58) Field of Search ..... 292/336.3, 63–66, 292/71, 110, 111, 113

(56) References Cited

U.S. PATENT DOCUMENTS

| | | | | |
|---|---|---|---|---|
| 3,325,200 A | | 6/1967 | Fowler | |
| 3,409,320 A | | 11/1968 | Eckerle | |
| 3,748,881 A | * | 7/1973 | Erickson | 70/388 |
| 3,964,280 A | * | 6/1976 | Kelton | 70/84 |
| 4,181,333 A | | 1/1980 | Stelma | |
| 4,705,308 A | | 11/1987 | Bisbing | |
| 4,707,006 A | | 11/1987 | Garg et al. | |
| 4,972,691 A | | 11/1990 | Knight | |
| 4,973,091 A | | 11/1990 | Paulson et al. | |
| 5,375,894 A | | 12/1994 | Schlack | |
| 5,413,391 A | | 5/1995 | Clavin et al. | |
| 5,732,987 A | | 3/1998 | Wright et al. | |
| 6,109,669 A | | 8/2000 | Pinkow | |
| 6,203,076 B1 | | 3/2001 | Wytcherley et al. | |
| 6,371,786 B1 | | 4/2002 | Howell et al. | |

* cited by examiner

*Primary Examiner*—Gary Estremsky
(74) *Attorney, Agent, or Firm*—Paul & Paul

(57) ABSTRACT

A pivoting handle latch for attachment to a first member, such as a panel, to provide controlled actuation for facilitating attachment of the first member to a second member, such as a cabinet, the latch including a handle with a gripping portion, a based portion, a pawl member and and a first pin connecting the pawl member to the handle and extending through a slot provided in the base member to regulate the movement of the pawl when the handle is lifted from a closed horizontal position to a upright vertical position.

8 Claims, 15 Drawing Sheets

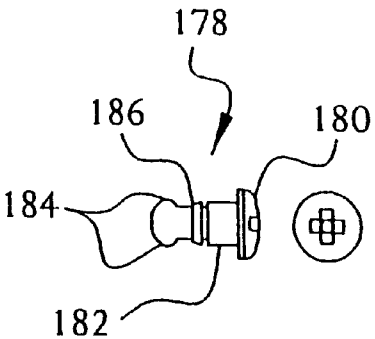
FIG. 20
FIG. 19
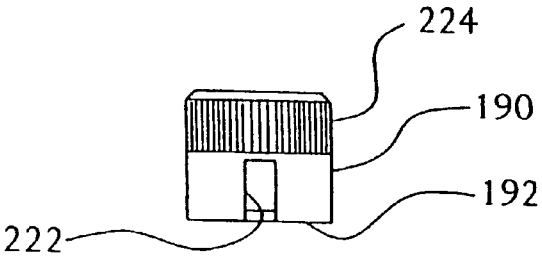
FIG. 25
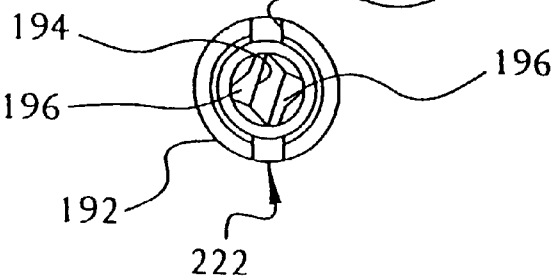
FIG. 24

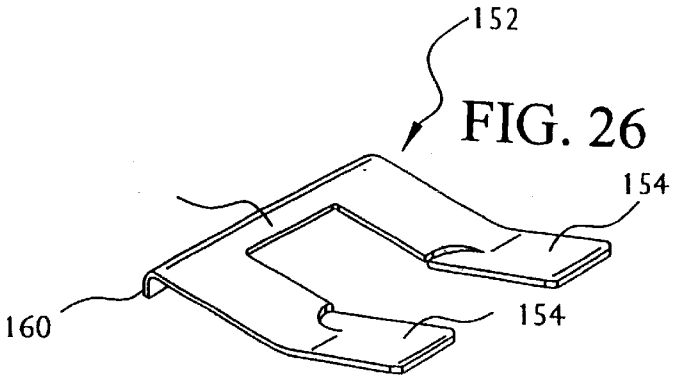
FIG. 26
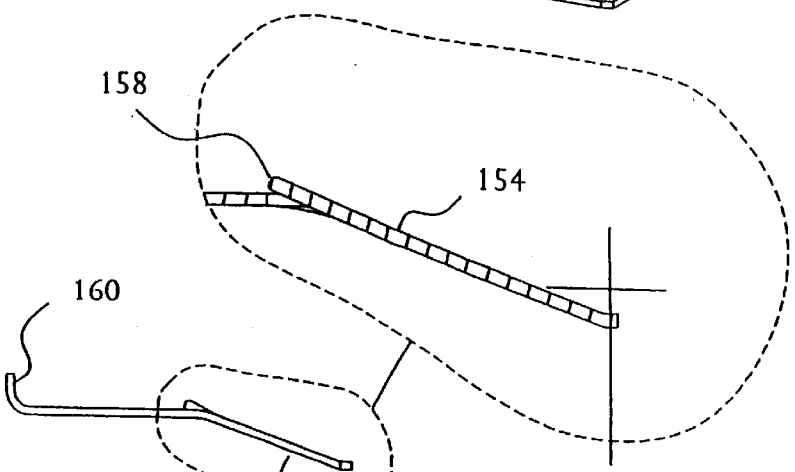
FIG. 29
FIG. 30
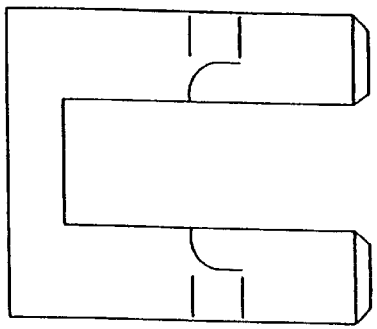
FIG. 28
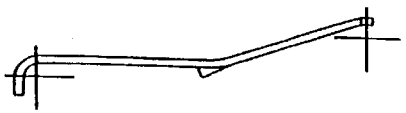
FIG. 27

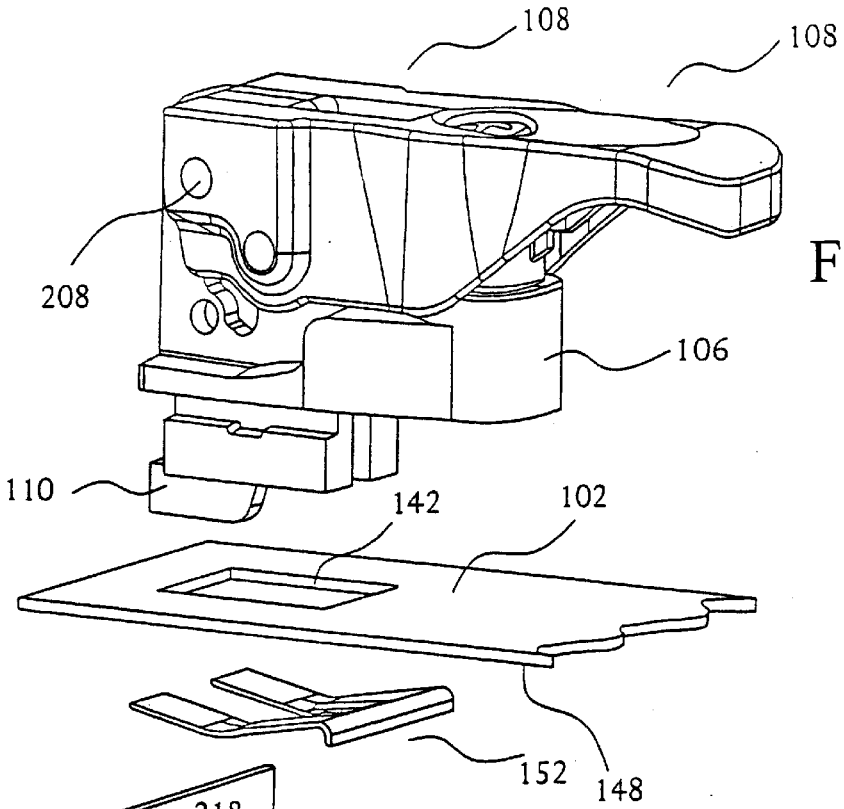
FIG. 31
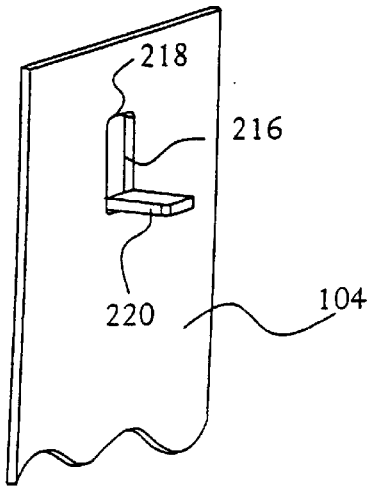
FIG. 32
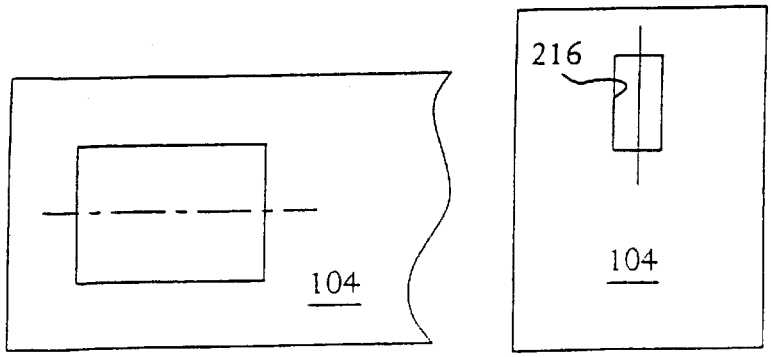

PIVOTING-HANDLE DEVICE

CROSS-REFERENCE TO RELATED APPLICATION

This application claims priority from U.S. Provisional Application No. 60/246,044, filed Nov. 6, 2000.

BACKGROUND OF THE INVENTION

1. Field of the Invention

The present invention relates to a latching device for releasably securing a closure member, such as a panel or door, in the closed position.

2. Description of the Prior Art

Latches for securing one member, such as a door, panel, drawer, etc., against another member, such as a frame, another door or panel, etc., are known in the prior art. However, none are seen to teach or suggest the unique features of the present invention or to achieve the advantages of the present invention.

SUMMARY OF THE INVENTION

The present invention is directed to a latch for releasably securing one closure member, such a panel, drawer, door, or lid, relative to another closure member, such as another panel, a doorframe, or a compartment opening. The latch includes a handle pivotally attached to a base. The base is adapted for attachment to a first member. A pawl is supported by the base and is movable between a closed position and an open position in response to pivotal movement of the handle. The pawl can be brought into engagement with a portion of a second member or a keeper attached to the second member in order to releasably secure the first member in a closed position relative to the second member. In the preferred embodiment, the latch is attached to the movable member, e.g. a door or panel, while the keeper is part of the stationary member or frame. However, the positions of the latch and keeper may be reversed and both members may be of the movable type.

BRIEF DESCRIPTION OF THE DRAWINGS

FIG. 19 is a side view of the quarter-turn fastener used with the latch assembly of the present invention.

FIG. 20 is a top view of the quarter-turn fastener used with the latch assembly of the present invention.

FIG. 24 is a bottom view of the receptacle installed in the base of the latch assembly of the present invention for engagement by the quarter-turn fastener.

FIG. 25 is a side view of the receptacle installed in the base of the latch assembly of the present invention for engagement by the quarter-turn fastener.

FIG. 26 is a perspective view of the spring clip used for retaining the latch assembly of the present invention in place after installation.

FIG. 27 is a side view of the spring clip used for retaining the latch assembly of the present invention in place after installation.

FIG. 28 is a top plan view of the spring clip used for retaining the latch assembly of the present invention in place after installation.

FIG. 29 is a cross-sectional view of the spring clip used for retaining the latch assembly of the present invention in place after installation.

FIG. 30 is a fragmentary view of the spring clip used for retaining the latch assembly of the present invention in place after installation, showing the catch tabs of the spring clip.

FIG. 31 is an exploded view showing the relationship of the latch assembly of the present invention in relation to a panel prepared for the installation of the latch assembly.

FIG. 32 is a perspective view showing a frame prepared for engagement by the pawl of the latch assembly of the present invention.

Similar reference characters denote corresponding features consistently throughout the attached drawings.

DETAILED DESCRIPTION OF THE PREFERRED EMBODIMENTS

Figure 1:
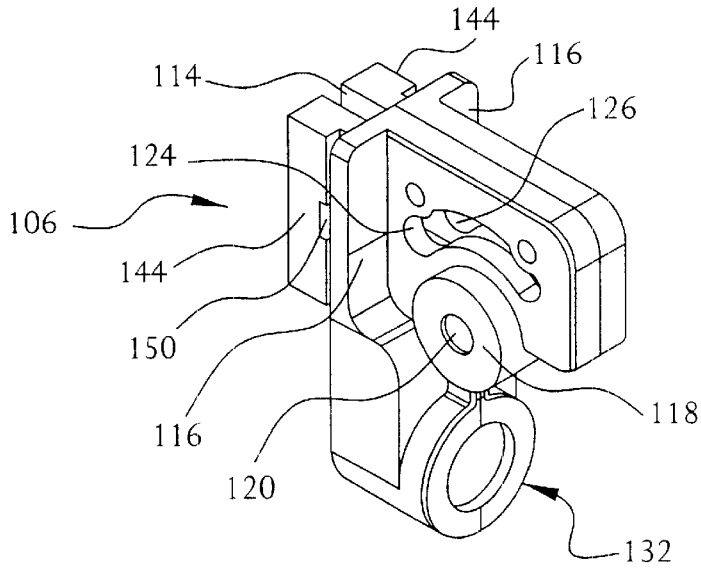
FIG. 1 is a top perspective view of the base of the latch assembly of the present invention.
Figure 3:
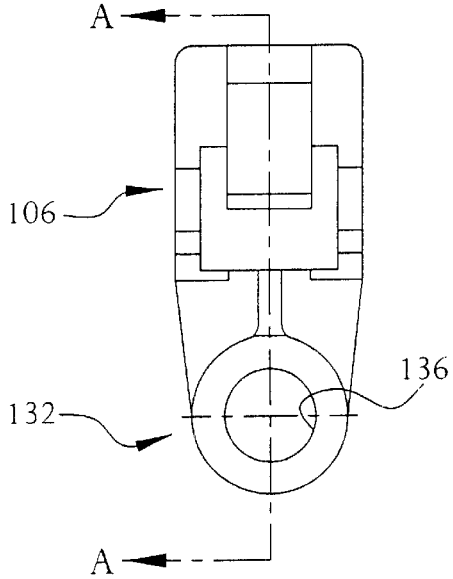
FIG. 3 is a top view of the base of the latch assembly of the present invention.
Figure 2:
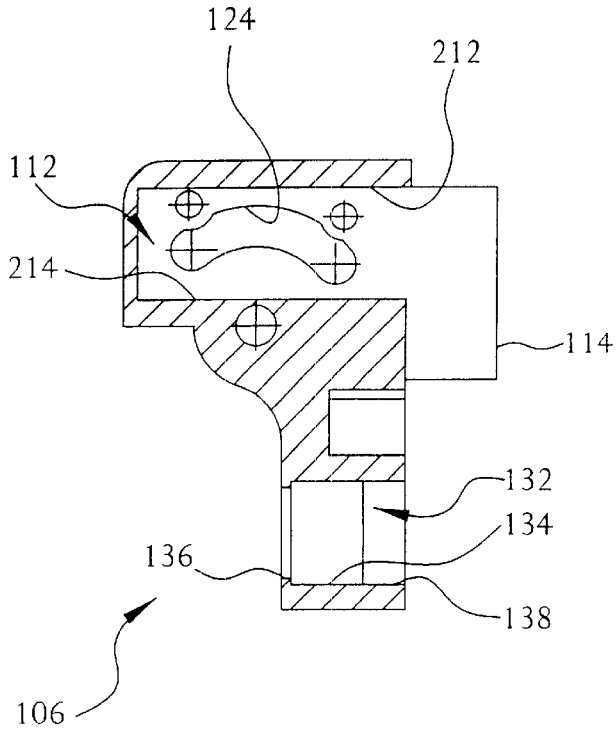
FIG. 2 is a cross-sectional view of the base of the latch assembly of the present invention.
Figure 5:
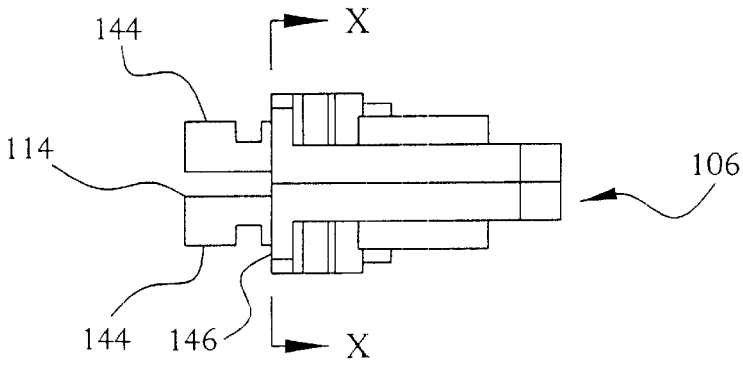
FIG. 5 is a rear view of the base of the latch assembly of the present invention.
Figure 4:
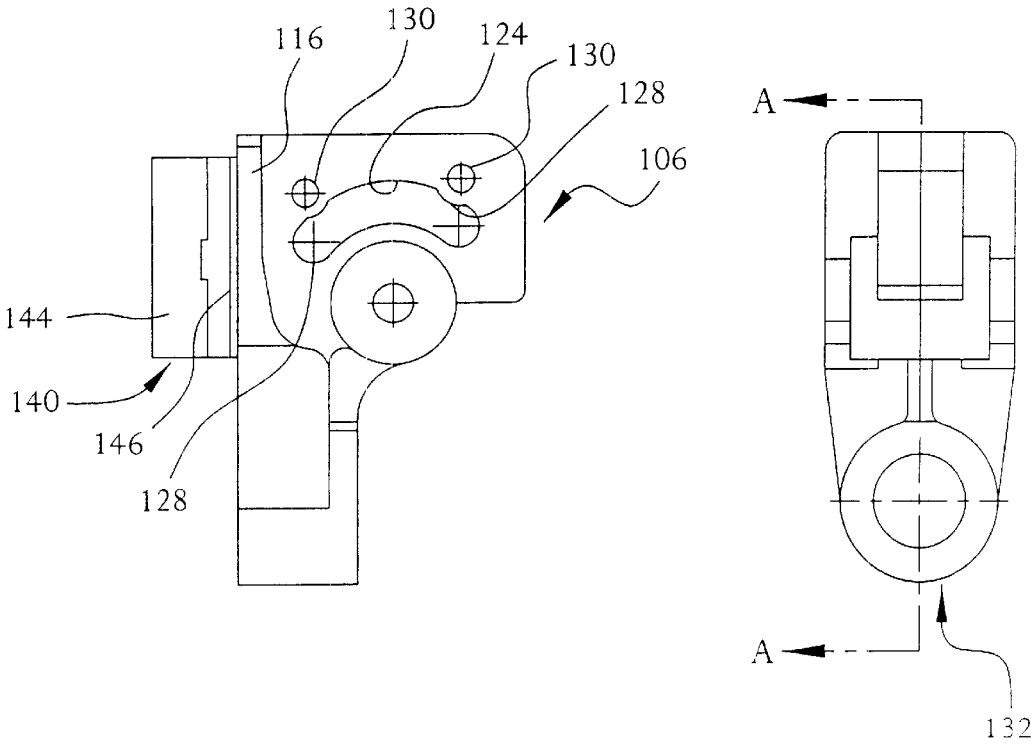
FIG. 4 is a right side view of the base of the latch assembly of the present invention.
Figure 6:
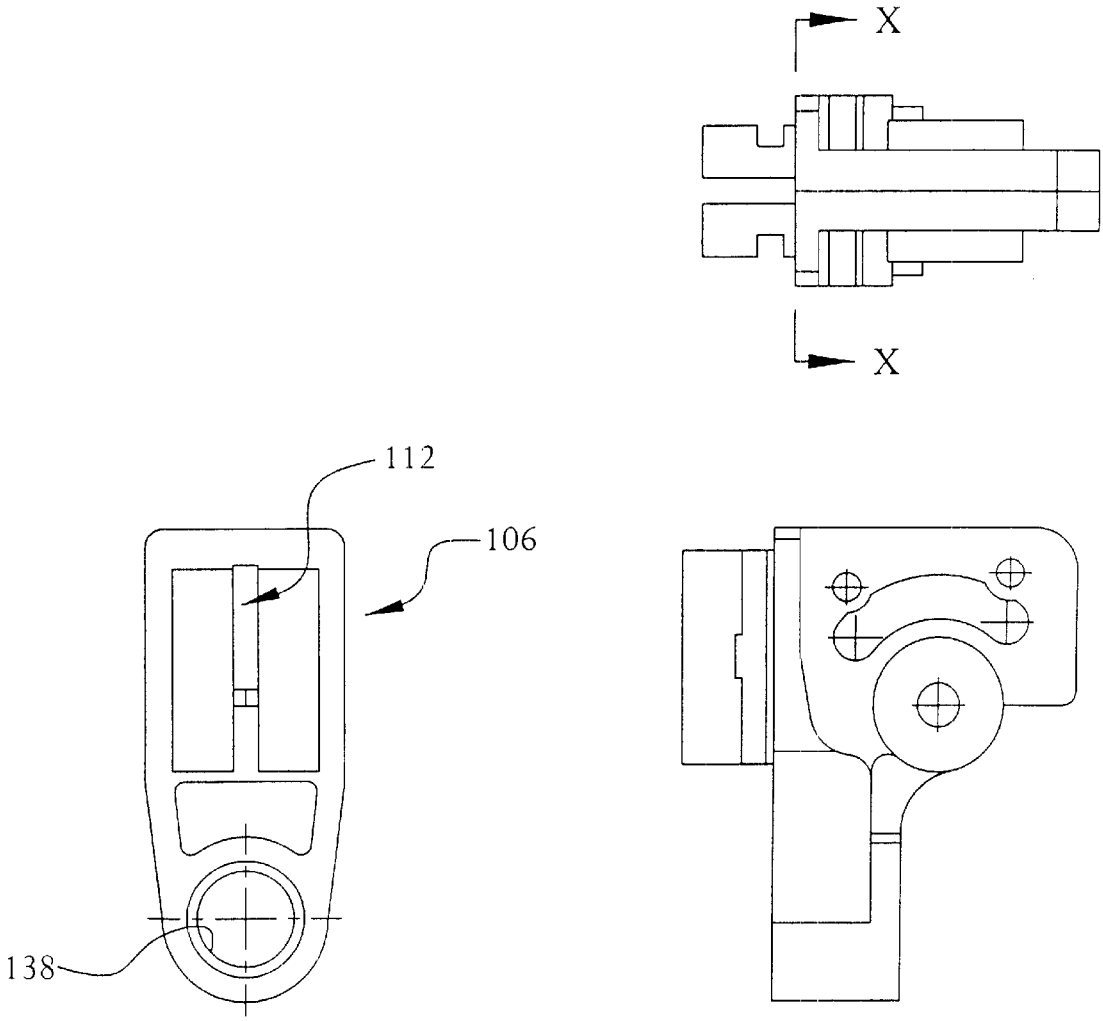
FIG. 6 is a bottom view of the base of the latch assembly of the present invention.
Figure 7:
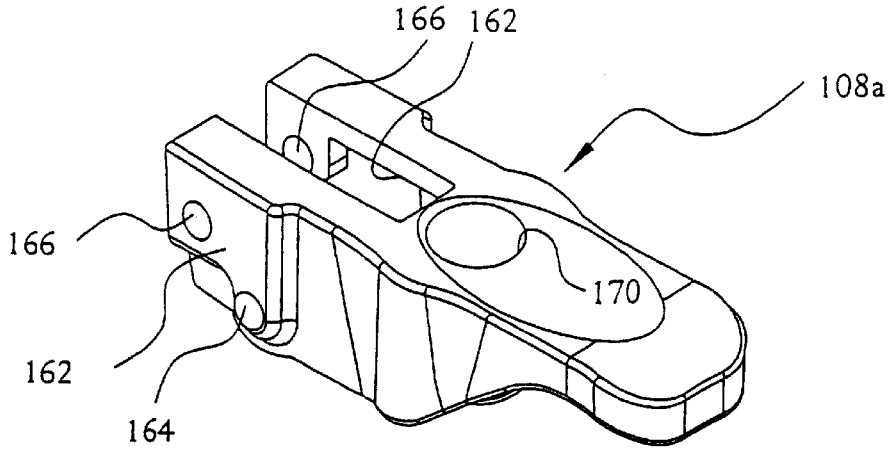
FIG. 7 is a perspective view of the handle of the latch assembly of the present invention.
Figure 8:
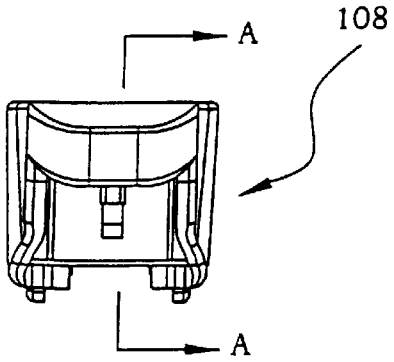
FIG. 8 is a front view of the handle of the latch assembly of the present invention.
Figure 10:
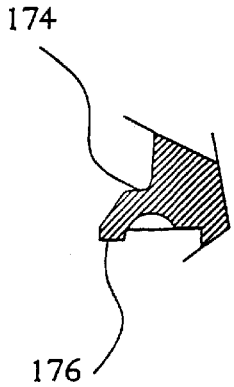
FIG. 10 is a fragmentary view showing the details of the resilient finger for capturing the quarter-turn fastener used with the latch assembly of the present invention.
Figure 9:
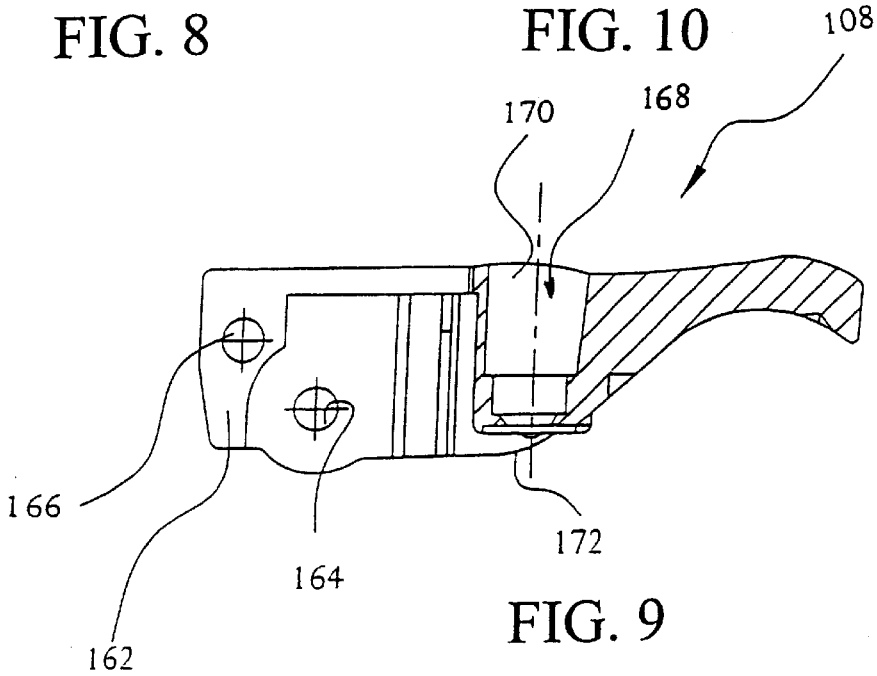
FIG. 9 is a cross-sectional view of the handle of the latch assembly of the present invention.
Figure 11:
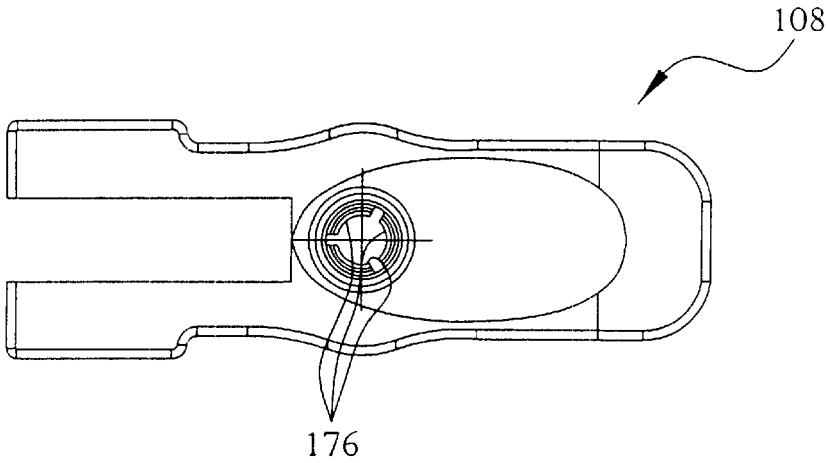
FIG. 11 is a top view of the handle of the latch assembly of the present invention.
Figure 12:
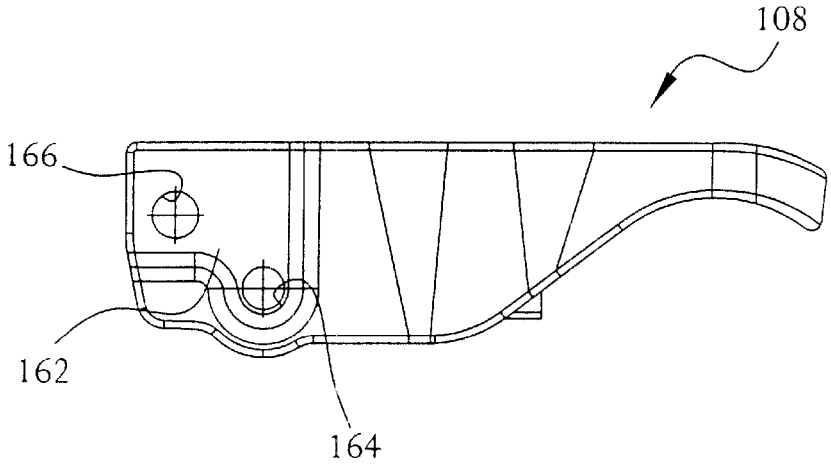
FIG. 12 is a right side elevational view of the handle of the latch assembly of the present invention.
Figure 13:
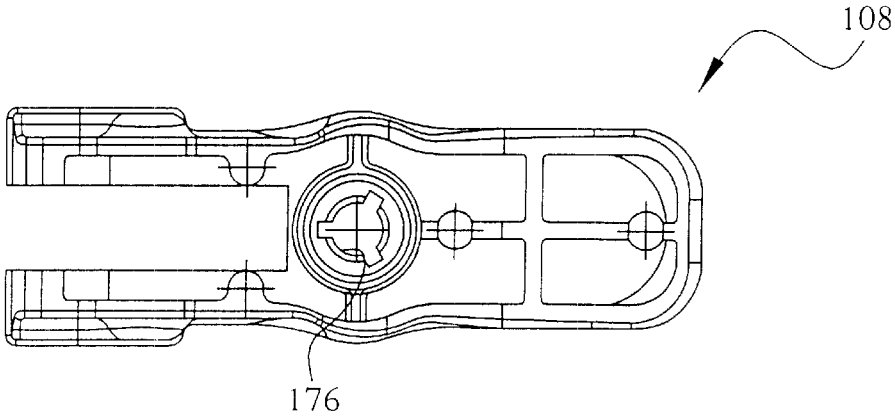
FIG. 13 is a bottom view of the handle of the latch assembly of the present invention.
Figure 14:
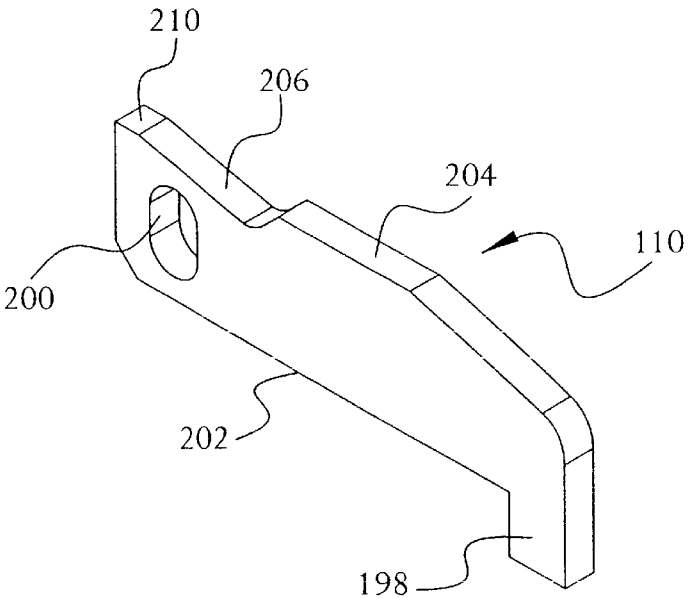
FIG. 14 is a perspective view of the pawl of the latch assembly of the present invention.
Figure 16:
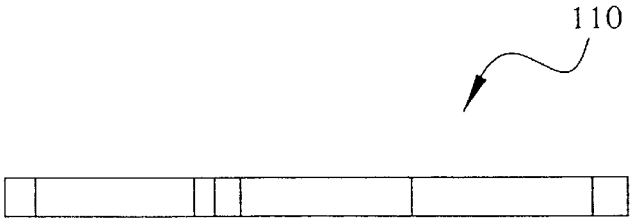
FIG. 16 is a front view of the pawl of the latch assembly of the present invention.
Figure 15:
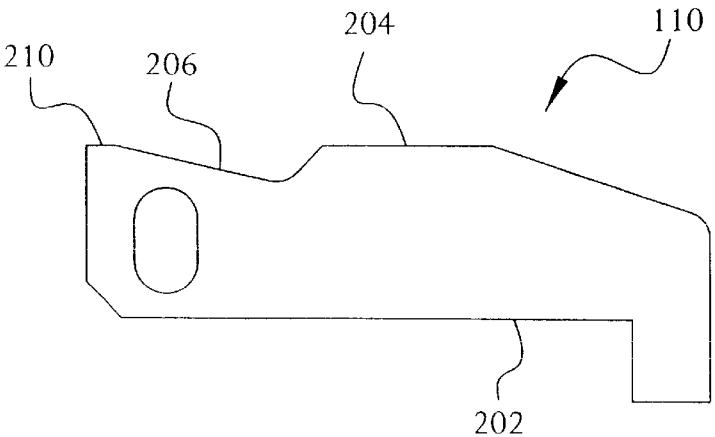
FIG. 15 is a right side view of the pawl of the latch assembly of the present invention.
Figure 18:
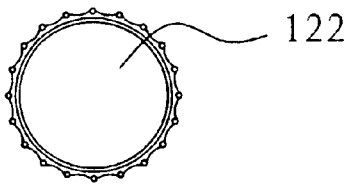
FIG. 18 is an end view of the pin used in the latch assembly of the present invention.
Figure 17:
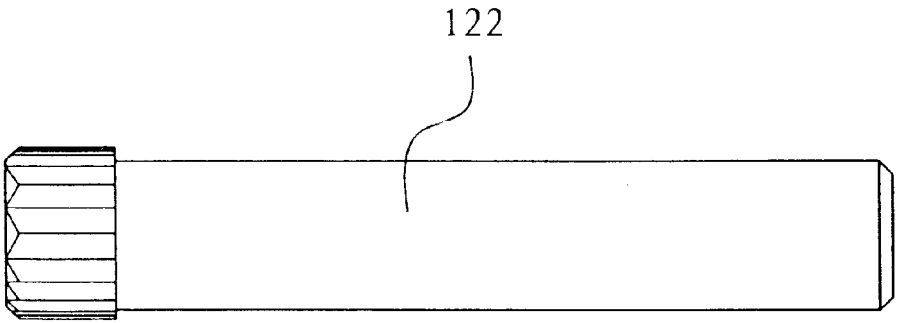
FIG. 17 is a side view showing the pin used with the latch assembly of the present invention.

Referring to FIGS. 1–34, the present invention is directed to a latch assembly 100 for use with closure members such as panels, lids, drawers, doors, etc. The latch assembly of the present invention is widely applicable to many kinds of doors, lids, windows, panels, and drawers. The latch 100 of the present invention releasably secures a first closure member, such as a panel 102, to a second closure member, such a frame 104 (only a portion of the frame is shown). The latch assembly 100 of the present invention includes a latch base 106, a handle 108, and a pawl 110.

The latch base 106 is best illustrated in FIGS. 1–6. The latch base 106 is roughly in the shape of a rectangular parallelepiped having an elongated cavity 112 extending from the bottom of the base 106 to near the top of the base. The cavity 112 terminates in a bottom opening 114 and is closed at the top. The base 106 has a flange 116 which abuts the panel 102 once the base 106 is installed to the panel 102. The base 106 has a cylindrical boss 118 located above the flange 116. The cylindrical boss 118 projects to either side of the top portion of the base 106. The cylindrical boss 118 has a central bore 120 for receiving the pivot pin 122 for pivotally attaching the handle 108 to the base 106. The walls of the cavity 112, in the upper portion of the base 106, are provided with arcuate slots 124 and 126 which are in registry with one another. The slots 124 and 126 follow circular arcs having a center of curvature which is coincident with the longitudinal axis of the bore 120. Near each end of each of the slots 124 is a resilient detent projection 128 for preventing uncontrolled movement of the handle 108. The resilience of each projection 128 is enhanced by thinning the material behind each projection by providing a hole 130 behind each projection.

The base 106 also includes a receptacle housing 132 which is integral with the rest of the base 106 and is attached to the rest of the base 106 in part by an extension of the flange 116. The housing 132 has a cavity 134 that is open at both the top and bottom. The top opening 136 of the cavity 134 is smaller than the bore of the cavity 134, while the bottom opening 138 of the cavity 134 is larger than the top opening 136 and may essentially be of the same size as the bore of the cavity 134. The portion 140, extending below the flange 116, is the lower portion of the base 106 and is inserted through an opening 142 in the panel 102 in order to mount the base 106 to the panel 102. The lower portion of the base also has flanges 144 which extend on either side of the bottom opening 114, flanges 144 are parallel to and spaced apart from the bottom surface 146 of the flange 116. The flange 116 is positioned below the inner surface 148 of the panel 102 when the base 106 is installed to the panel 102. Each flange 144 has a notch 150 for retaining the spring clip 152.

The base 106 is installed to the panel 102 by inserting the lower portion 140 through the opening 142 until the lower surface 146 of the flange 116 abuts the outer surface of the panel 102. The base 106 is oriented such that the rear of the base 106 is closest to the edge of the panel 102. The spring clip 152 is then inserted between the inner surface 148 of the panel 102 and the flanges 144. The spring clip 152 has a pair of leaf spring arms 154 that extend in parallel from a transverse strip 156. The spring arms 154 have a shallow V-shaped profile and are spaced apart such that the portion of the base 106 intermediate the flange 116 and the flanges 144 can fit between the arms 154. At the apex of each arm 154 is a projecting tab 158 which extends toward the transverse strip 156. The transverse strip 156 has a down-turned lip 160. With the spring clip 152 inserted between the inner surface 148 of the panel 102 and the flanges 144, each of the tabs 158 snaps into a respective notch 150. This arrangement prevents the spring clip 152 from sliding out accidentally from between the inner surface 148 of the panel 102 and the flanges 144. The spring clip 152 is wider than the opening 142 such that after insertion of the spring clip 152 the lower portion of the base 106 cannot be pulled back through the opening 142. Because of the flexibility of the spring clip 152, the base 106 can be installed to panels of varying thickness. This is due to the fact that the angle between the portions of each arm 154 on either side of the apex of each arm can vary to accommodate panels of different thickness.

Referring to FIGS. 7–13, the handle 108 can be seen. The handle 108 has two sidewalls 162 that extend in parallel on either side of the top portion of the base 106. Each sidewall 162 has a pair of holes 164 and 166. The holes 164 are placed in registry with the bore 120. The pivot pin 122 is the inserted through the holes 164 and the bore 120 to pivotally attach the handle 108 to the base 106. The handle 108 has a quarter-turn fastener housing 168 which has a top opening 170 and a bottom opening 172. A shoulder 174 is provided near the bottom opening 172. A plurality of resilient fingers 176 are distributed along the perimeter of the bottom opening 172. The resilient fingers 176 project radially inward from the perimeter of the bottom opening 172.

Figure 21:
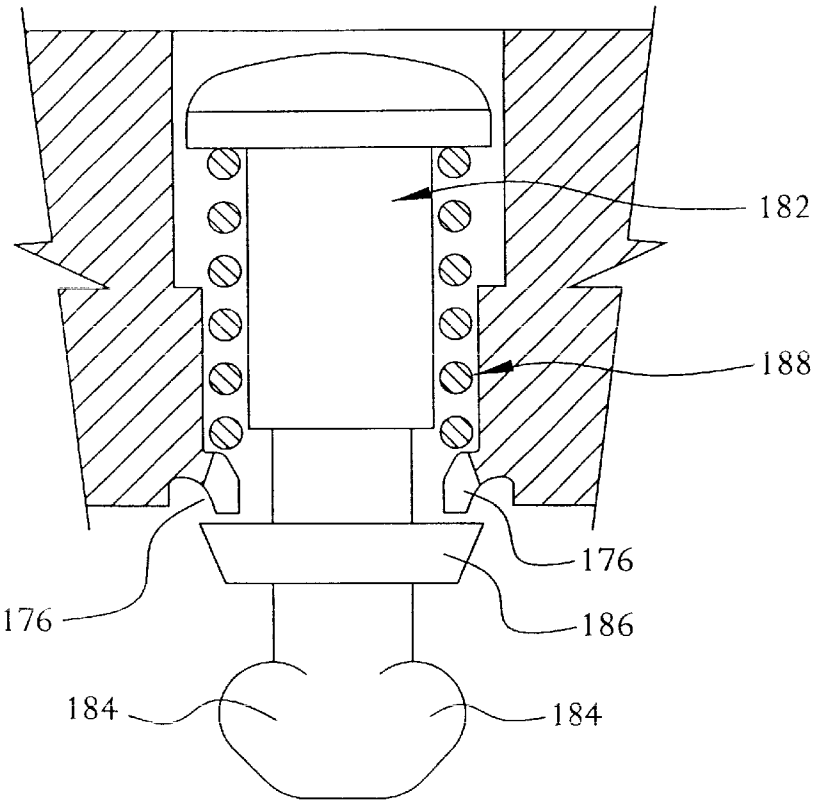
FIG. 21 is a fragmentary view showing the quarter-turn fastener and spring installed in the handle of the latch assembly of the present invention.
Figure 23:
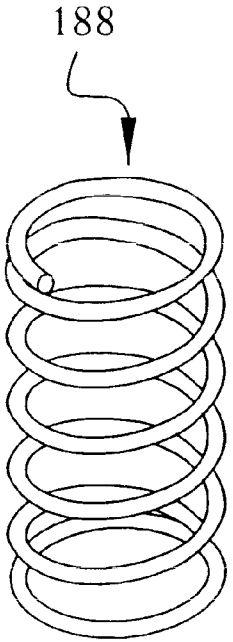
FIG. 23 is a perspective view of the coil spring used in the latch assembly of the present invention.
Figure 22:
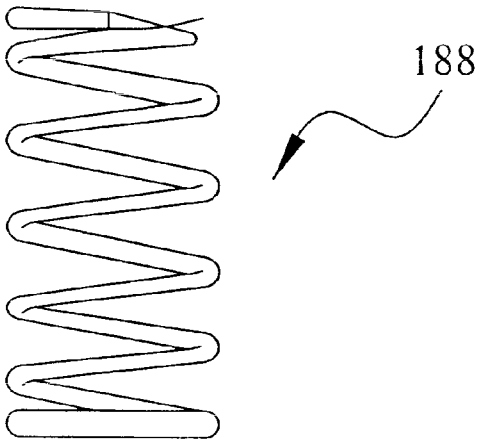
FIG. 22 is a side view of the coil spring used in the latch assembly of the present invention.
Figure 33:
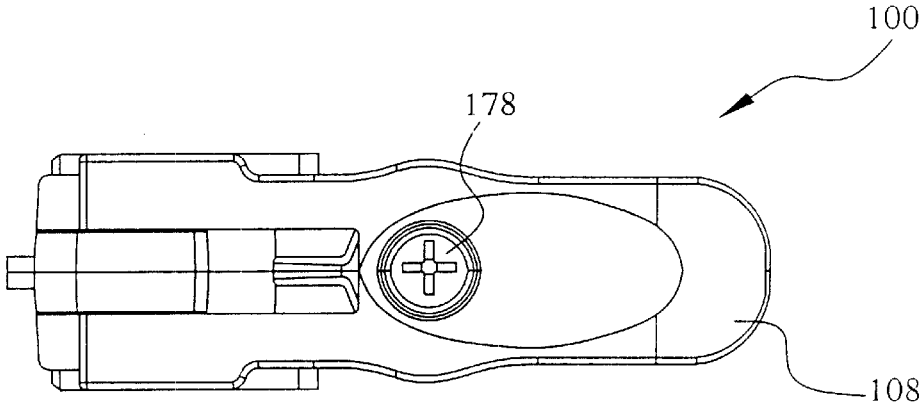
FIG. 33 is a top view of the latch assembly of the present invention.

An example of a quarter-turn fastener 178 for use with the latch 100 can be seen in FIGS. 19–21. The quarter-turn fastener 178 has a head 180 and a shaft 182. The tip of the shaft 182 distal from the head 180 is provided with a pair of opposing flukes 184. Intermediate the head 180 and the flukes 184, an annular flange 186 is provided on the shaft 182. The coil spring 188 is placed around the shaft 182 and bears against the head 180 at one end. As the fastener/spring assembly is inserted through the top opening of the fastener housing 168, the other end of the spring 188 bears against the shoulder 174 and the flange 186 snaps through the resilient fingers 176 such that the quarter-turn fastener cannot be pulled back out through the top opening of the fastener housing 168. The spring 188 biases the fastener 178 toward the retracted position wherein the flange 186 abuts the fingers 176.

Figure 34:
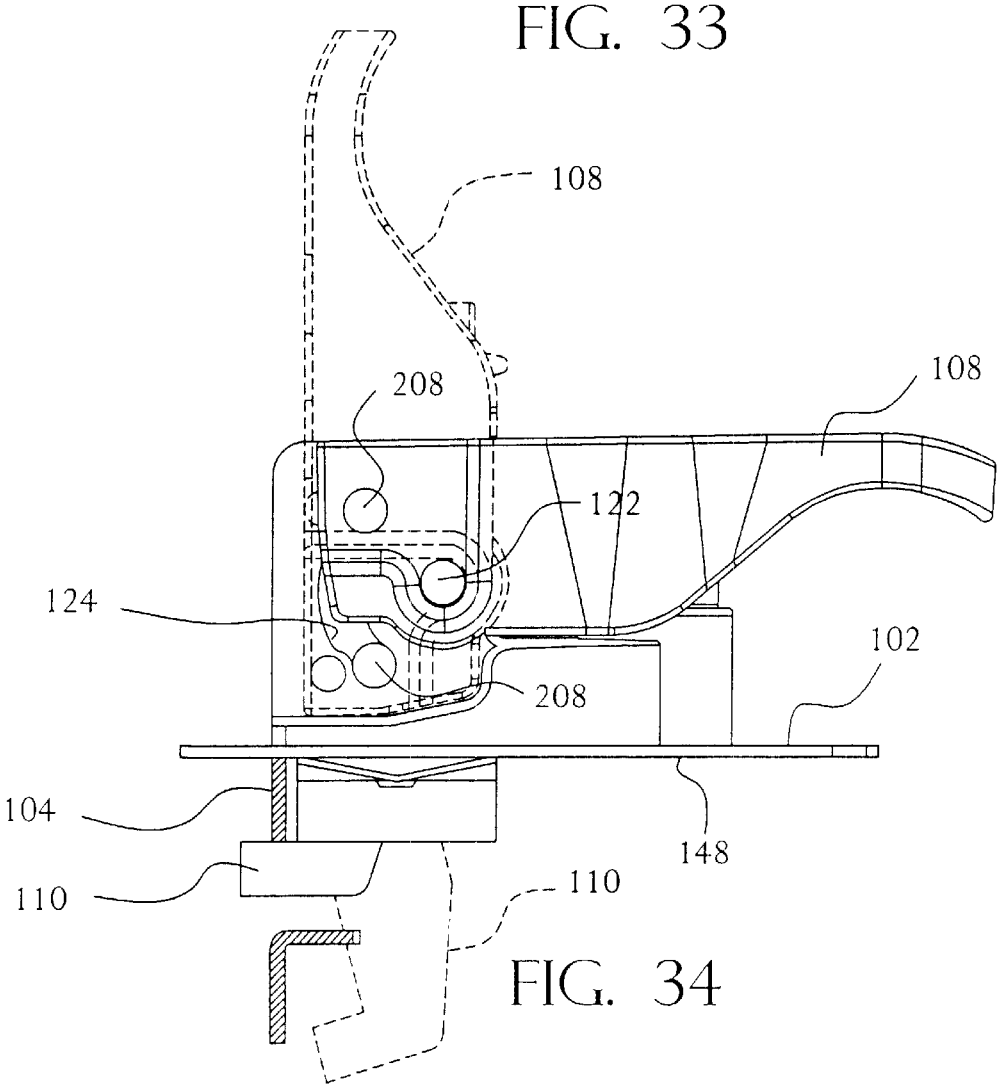
FIG. 34 is an environmental view of the base of the latch assembly of the present invention with the open positions of the handle and pawl shown in dashed lines.
Figure 35:
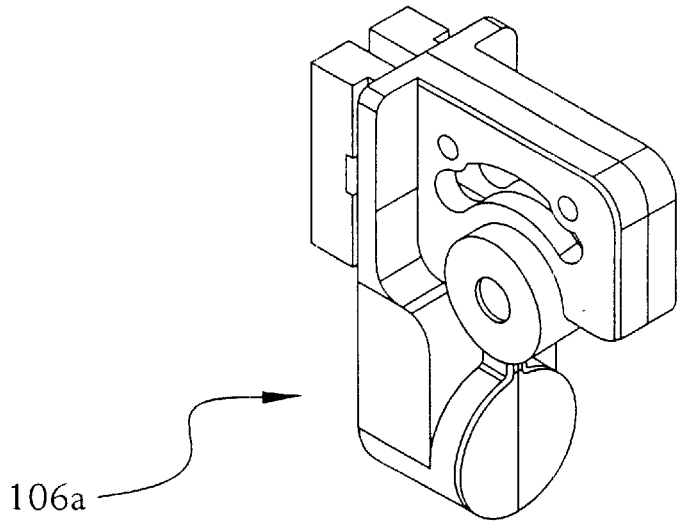
FIG. 35 is a top perspective view of a second embodiment of the base of the latch assembly of the present invention.
Figure 37:
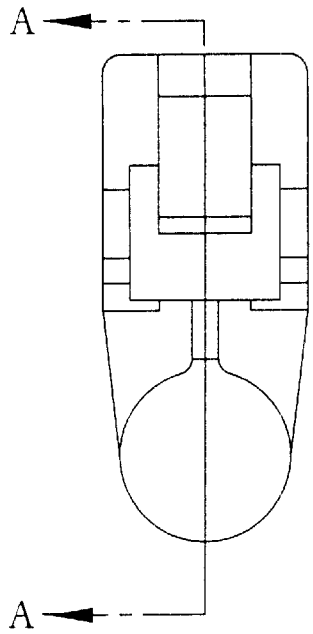
FIG. 37 is a top view of a second embodiment of the base of the latch assembly of the present invention.
Figure 36:
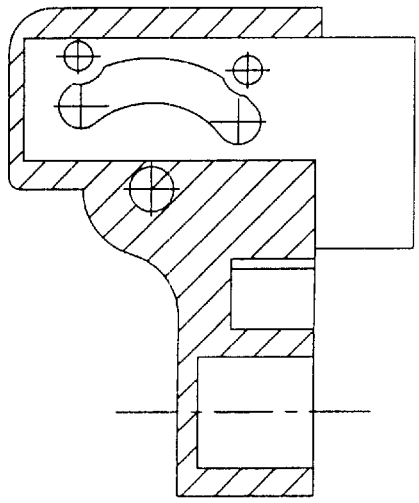
FIG. 36 is a cross-sectional view of a second embodiment of the base of the latch assembly of the present invention.
Figure 38:
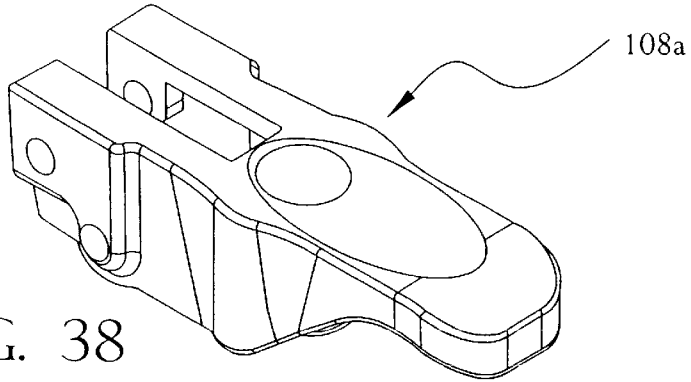
FIG. 38 is a top perspective view of a second embodiment of the handle of the latch assembly of the present invention.
Figure 39:
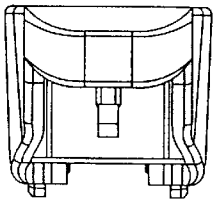
FIG. 39 is a front view of a second embodiment of the handle of the latch assembly of the present invention.
Figure 40:
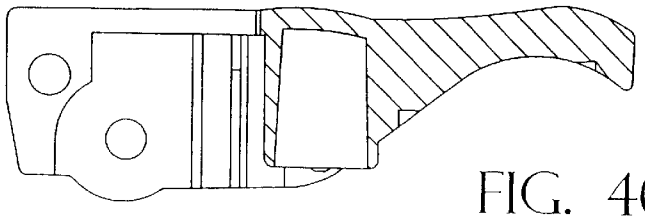
FIG. 40 is a cross-sectional view of a second embodiment of the handle of the latch assembly of the present invention.

The handle 108 moves pivotally between the open (dashed lines) and closed (solid lines) positions shown in FIG. 34. In the closed position the fastener housing 168 registers with the receptacle housing 132 such that the fastener 178 can engage the quarter-turn fastener receptacle 190. The receptacle 190 is pushed into the receptacle housing 132 from the bottom through the opening 138 and is held within the receptacle housing 132 by a press fit. The fastener receptacle 190 is cylindrical and has an open bottom 192 and a top opening 194 that is specially shaped to allow the passage of the flukes 184 therethrough. The receptacle 190 also has a pair of alignment cuts 222 and a serrated portion 224 to aid in retaining the receptacle 190 within the receptacle housing 132. A pair of stops 196 are provided on either side of the opening 194. With the handle 108 in the closed position, the quarter-turn fastener can be pushed against the pressure of the spring 188 such that the tip portion of the fastener 178 including the flukes 184 is inserted into the opening 194. Once the flukes 184 clear the opening 194, the fastener 178 is turned a quarter of a turn to position the flukes 184 behind the stops 196. Once the flukes 184 are positioned behind the stops 196, the fastener 178 cannot be disengaged from the receptacle 190 and the handle is locked in the closed position. Turning the fastener 178 back a quarter turn once again brings the flukes 184 into proper alignment with the opening 194 such that the flukes clear the stops 196 and the bias of the spring 188 disengages the fastener 178 from the receptacle 190. The handle 108 can now be moved pivotally to the open position without interference from the fastener 178.

The turning of the fastener 178 can be accomplished with or without tools depending upon the type of head provided for the fastener 178. In the illustrated example, the fastener 178 is of the phillips head type and can be turned by a phillips head screwdriver.

The pawl 110 is elongated and has an L-shaped end 198. Distal from the L-shaped end, the pawl 110 is provided with an elongated slot 200. The pawl 110 also has parallel surfaces 202 and 204, and an angled surface 206. The slotted end of the pawl 110 is positioned within the cavity 112 such that the longitudinal axis of the slot 200 transects the arc followed by the slots 124 and 126. A second pin 208 passes through the holes 166, the slots 124 and 126, and the slot 200 to attach the pawl 110 to the handle 108. The pin 208 moves along a circular arc as the handle 108 is moved pivotally between the open and the closed position. The pin 208 can be similar to the pin 122. The L-shaped end of the pawl 110 remains outside the cavity 112. As the handle 108 is pivotally moved from the closed position to the open position, the L-shaped end of the pawl 110 is moved outward away from the base 106, while moving the handle 108 to the closed position draws the L-shaped end of the pawl 110 toward the base 106.

With the handle 108 in the closed position, the surfaces 202 and 204 are adjacent the walls 212 and 214 of the cavity 112 and the movement of the pawl 110 is essentially linear during the initial phase of the movement of the handle 108 to the open position. Once the surface 204 clears the walls of the cavity 112, the pawl 110 will start to move pivotally as well as linearly such that the L-shaped end of the pawl pivots counter clockwise in the view of FIG. 34. The pivotal movement of the pawl 110 is due to the reaction forces at the corner 210 of the pawl, which remains in contact with the wall 214 of the cavity 112, and the force exerted on the pawl 110 by the pin 208. Once the handle 108 reaches the open position, the angled surface 206 is pressed flat against the wall 214 of the cavity 112 with the result that the L-shaped end of the pawl 110 is moved toward the front of the base 106. Thus, during opening the L-shaped end of the pawl 110 is moved downward and forward. Moving the handle 108 to the closed position reverses this movement such that the L-shaped end of the pawl 110 is moved rearward and upward.

In use, the frame 104 is provided with an aperture 216. When the panel 102 is moved to the closed position and as the handle 108 is also moved to the closed position, the L-shaped end of the pawl 110 moves into the aperture 216 and is pulled up against the top side 218 of the aperture to thereby tightly secure the panel 102 against the frame 104. This action allows the compression of any gasket or the like between the panel 102 and the frame 104. Moving the handle 108 toward the open position, initially lowers the L-shaped end of the pawl 110 out of engagement with the top side 218 of the aperture 216 and then pivotally moves the L-shaped end of the pawl 110 completely out of the aperture 216 to thereby allow opening of the panel 102. Preferably, a shelf 220 is provided at the bottom of the aperture 216 such that the pawl 110 impacts the shelf 220 and provides an initial opening of the panel 102 as the handle 108 is moved to the open position.

Referring to FIGS. 35–40, a second embodiment 106*a* and 108*a* of the base and handle of the latch can be seen. The base and handle 106*a* and 108*a* are identical to those of the latch 100 except that the openings 136 and 170 have been eliminated from the base 106*a* and the handle 108*a*, respectively, to create a non-locking version of the latch 100.

It is to be understood that the present invention is not limited to the embodiments described above, but encompasses any and all embodiments within the scope of the following claims.

We claim:

1. A pivoting handle latch device, comprising:

(a) an elongate housing having a hollowed area within;

(b) a handle having a gripping portion and a body portion, said body portion straddling said housing and rotatively attached thereto said housing body portion having a pair of parallel spaced apart sidewalls each having an arcuate slot therein, said handle also having a cylindrical bore extending through said gripping portion;

(c) a pawl member operating within said housing hollowed area and having a pivot pin for pivotal attachment to said handle, wherein said pawl attachment pin extends through said housing sidewalls arcuate slots; and (d) a locking pin received in said cylindrical bore of said handle gripping portion;

(e) wherein said cylindrical bore of said handle gripping portion also includes a plurality of resilient fingers for retaining said received locking pin.

2. The device of claim 1, wherein each said arcuate slot includes a resilient detent projection at each end thereof.

3. The device of claim 2, wherein said housing also includes a cylindrical base having a bore therethrough which opens to said hollowed area; and wherein said locking pin extends into said housing cylindrical base when said handle is pivoted down onto said housing.

4. The device of claim 3, wherein said housing cylindrical base bore has a an enlarged diameter at the handle adjacent end thereof, and an inward shoulder at the other end thereof.

5. The device of claim 4, including a spring clip, and wherein said housing body portion sidewalls each includes a flange, wherein said flanges each have a channel with a notch therein for receiving said spring clip.

6. The device of claim 5, wherein each of said body portion sidewalls has plural holes therethrough, one each adjacent a respective detent projection and contributing to the resiliency thereof.

7. The device of claim 6, wherein said pawl member has a L-shaped end and an aperture at the opposite end, wherein said aperture is traversed by said pawl pivot pin, wherein said pawl member is moved into and out engagement with a frame by movement of said handle via said first pivot pin.

8. The device of claim 7, wherein said opposite end of said pawl has a camming surface thereby forcing pivotal movement of said pawl when said pawl is moved into contact with said housing body portion.

* * * * *

UNITED STATES PATENT AND TRADEMARK OFFICE

CERTIFICATE OF CORRECTION

PATENT NO. : 6,565,135 B2
DATED : May 20, 2003
INVENTOR(S) : Roger Wytcherley and Clive Morgan It is certified that error appears in the above-identified patent and that said Letters Patent is hereby corrected as shown below:

Column 6,
Line 49, insert -- also -- before “including”.

Signed and Sealed this

Ninth Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,565,135 B2
APPLICATION NO. : 09/992812
DATED : May 20, 2003
INVENTOR(S) : Roger Wytcherley et al.

It is certified that error appears in the above-identified patent and that said Letters Patent is hereby corrected as shown below:

Column 6, line 24, before “rotatively” insert --being--;
Column 6, line 25, after “thereto” insert--; (c)--;
Column 6, line 25, delete “body portion”;
Column 6, line 27, after “therein” change “,” to --;-- and insert --(d)--;
Column 6, line 29, change “(c)” to --(e)--;
Column 6, line 34, change “(d)” to --(f)--;
Column 6, line 36, change “(e)” to --(g)--;
Column 6, line 51, delete “body portion” ;
Column 6, line 52, insert --each of-- after “wherein” and delete “each” after “flanges”;
Column 6, line 62, change “first” to --pawl--;
Column 6, line 65, delete “body portion.”.

Signed and Sealed this

Fourth Day of September, 2007

JON W. DUDAS
*Director of the United States Patent and Trademark Office*